US005180944A

United States Patent [19]

Neilson

[11] Patent Number: 5,180,944

[45] Date of Patent: Jan. 19, 1993

[54] GYROTRON WITH A MODE CONVERTOR WHICH REDUCES EM WAVE LEAKAGE

[75] Inventor: Jeffrey M. Neilson, Mountain View, Calif.

[73] Assignee: Varian Associates, Inc., Palo Alto, Calif.

[21] Appl. No.: 645,946

[22] Filed: Jan. 25, 1991

[51] Int. Cl.[5] ..... H01J 23/16; H01P 1/16

[52] U.S. Cl. ..... 315/5; 331/79; 333/21 R

[58] Field of Search ..... 315/4, 5, 5.25, 5.31, 315/5.38; 333/21 R; 330/44; 331/79, 80, 91

[56] References Cited

U.S. PATENT DOCUMENTS 4,200,820 4/1980 Symons ..... 315/4
4,460,846 7/1984 Taylor ..... 315/5 X
4,554,484 11/1985 Read et al. ..... 315/5 X
4,636,689 1/1987 Moorien ..... 315/4
4,668,894 5/1987 Barnett et al. ..... 315/4
4,897,609 1/1990 Mallavarpu ..... 315/4 X
4,918,049 4/1990 Cohn et al. ..... 315/4 X
5,030,929 7/1991 Moeller ..... 315/4 X

FOREIGN PATENT DOCUMENTS 132361 1/1988 Japan ..... 315/4

*Primary Examiner*—Paul M. Dzierzynski
*Assistant Examiner*—Benny T. Lee

[57] ABSTRACT

In a gyrotron having an annular collector for an expanded e-beam and a gyrotron output waveguide with an annular gap for passing the expanded e-beam is provided with a mode converter between the resonator and the gap to shift more energy to the waveguide central axis to decrease EM field leakage coupling through said gap.

6 Claims, 5 Drawing Sheets

GYROTRON WITH A MODE CONVERTOR WHICH REDUCES EM WAVE LEAKAGE

FIELD OF THE INVENTION

The invention pertains to gyrotron electron tubes for generating high electromagnetic wave power at very high frequencies. The crossed-field gyrotron tube has become the most preferred for these purposes.

PRIOR ART

The original gyrotrons transmitted the spent electron beams into a hollow waveguide extending coaxially downstream from the interaction cavity and also transmitting the output power through a dielectric waveguide window. Beyond the interaction cavity the axial magnetic field needed for interaction with the cavity electric field was reduced so that electrons in the beam followed the magnetic field lines outward and were collected on the inner waveguide wall before they reached the output vacuum window. There were two main problems with this design. Some electrons left their proper trajectories and struck the window, causing charging and dangerous heating. Also, the collecting area was limited by the requirement that the wave be transmitted through the guide-collector without loss or conversion to unwanted modes. Efforts to enlarge the waveguide in the collector area and taper it back down toward the output had only limited success, due to generation of spurious (higher-order) wave modes in the enlarged section.

One attempt to separate the waveguide and the collector functions is illustrated by U.S. Pat. No. 4,200,820 issued Apr. 29, 1980 to Robert S. Symons. This covers a circuit for reflecting the output power radially away from the beam by a mitered mirror with a hole large enough for the beam. It was not very successful because spurious modes were generated by the incomplete mirror and also too much wave power went through the hole.

Another arrangement is described in U.S. Pat. No. 4,460,846 issued Jul. 17, 1984 to Norman Taylor. A gap is left in the output waveguide through which the beam expands into a larger, surrounding collector. The wave was supposed to pass straight through across the gap, but diffraction of the wave fields at the gap ends lost a lot of the power outward into the collector.

SUMMARY OF THE INVENTION

The objective of the invention is to provide means for diverting the electron beam outward through a gap in the waveguide into a larger collector while passing the wave energy through the gap with reduced wave power loss into the collector.

This objective is realized by converting at least part of the waveguide energy into a higher-order mode and transmitting at least the higher-order mode across the gap. The higher-order mode has more of its energy nearer the center of the guide than the original mode, and the resulting mode mixture can have significantly decreased energy losses to the gap (reduced diffraction) compared to the original mode.

DESCRIPTION OF THE PREFERRED EMBODIMENTS

Figure 1:
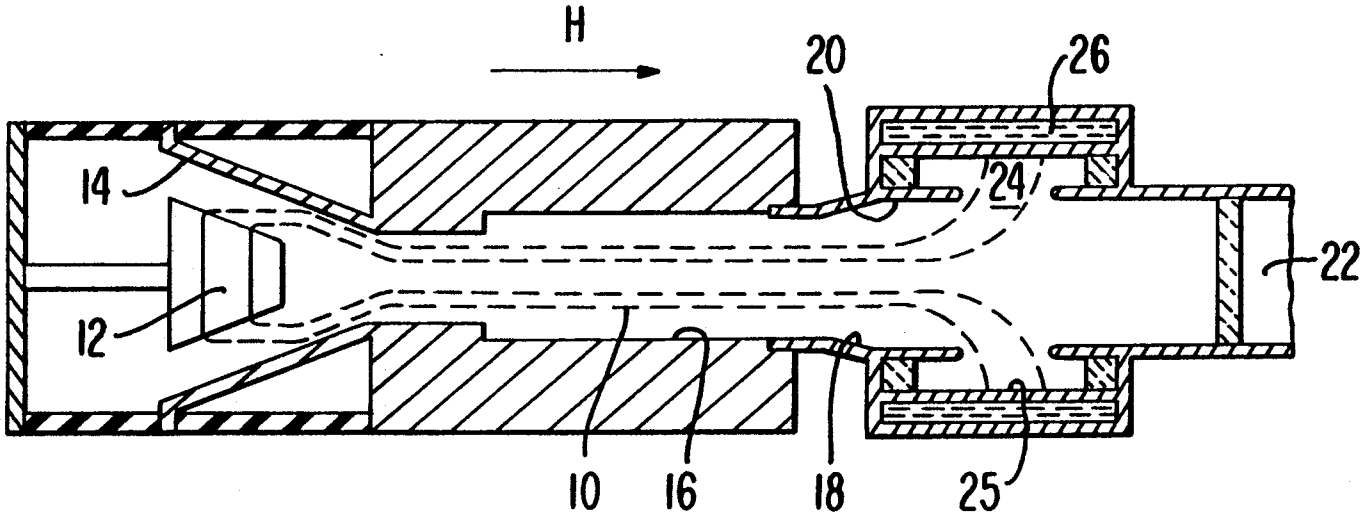
FIG. 1 PRIOR ART
FIG. 1 is an axial section of a gyrotron embodying the closest prior art.

FIG. 1 is a schematic axial section of a prior art gyrotron. A hollow beam of electrons 10 is drawn from the emitting zone 12 of a conical cathode by a facing conical anode 14. In a strong axial magnetic field H the radial motion of electrons 10 is converted into a rotating motion around the axis. The axial component of electric field produces axial motion causing beam 10 to progress through an interaction cavity 16 where the orbiting motions of electrons generate an electromagnetic wave at a resonant frequency of cavity 16 which is made equal to the cyclotron frequency of the transverse orbiting of the electrons in the axial magnetic field in cavity 16. The field pattern or "mode" of the wave is determined by the shape and dimensions of cavity 16.

Downstream of interaction cavity 16, the beam 10 and the output wave enter an output coupling section 18 for coupling the standing wave in cavity 16 to a traveling wave in the somewhat larger uniform output waveguide 20. In this waveguide region the axial magnetic field is reduced by terminating the surrounding solenoid magnet (not shown). The electrons are pushed outward by space-charge repulsion and by the outward flowing magnetic field lines. The traveling electromgnetic wave (EM) proceeds axially through waveguide 20 and exits through a dielectric vacuum window 22.

Waveguide 20 is too small to collect the spent electrons and dissipate their energy. In this prior-art arrangement there is an axial gap 24 in waveguide 20 through which electron beam 10 passes outward to strike the much larger collector surface 25 where the heat is carried off by circulating liquid coolant 26.

In this prior art scheme, the wave energy that was diffracted at the edges of gap 24 and flowed out into collector 25 proved to be excessive. The upstream end of the gap is analogous to an antenna whose side lobes spread away from the direct main lobe.

Figure 2:
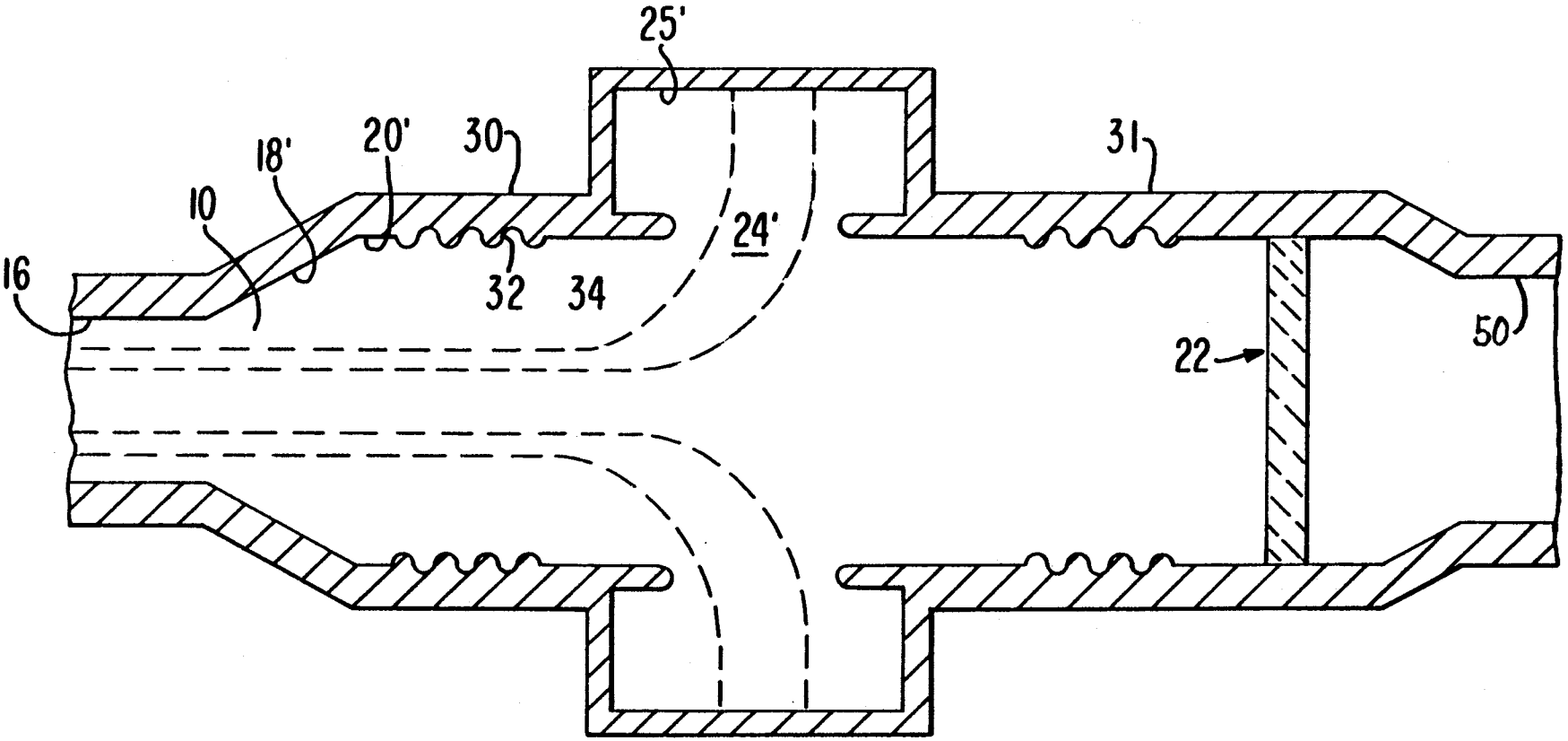
FIG. 2 is an axial section of the output portion of a gyrotron embodying the invention.

FIG. 2 is a schematic axial section of the wave output and beam collector portion of a gyrotron embodying the invention. It is structurally similar to the prior art of FIG. 1 except that output waveguide 20' may be larger to carry a higher-order wave mode. A region 30 of waveguide 20' between output taper 18' and gap 24' is a mode converter to divert part of the wave energy out of the mode in the interaction cavity into a higher-order mode which has lower currents in the waveguide wall and less loss by diffraction at the edges of gap 24'. The wave energy, now carried by a mixture of the two modes (a composite mode), is spread more evenly over the waveguide section and so radiates across gap 24' with less spreading.

Beyond gap 24' the two modes may be carried off, mixed, in an oversize waveguide. Alternatively, it may be desirable to restore the original cavity mode. To do this, a second mode converter section 31 may be used to reconvert the higher order mode generated in first converter 30, back to the original lower-order cavity and waveguide mode. The waveguide 20' may then be tapered down to a suitable size guide 50.

Figure 3:
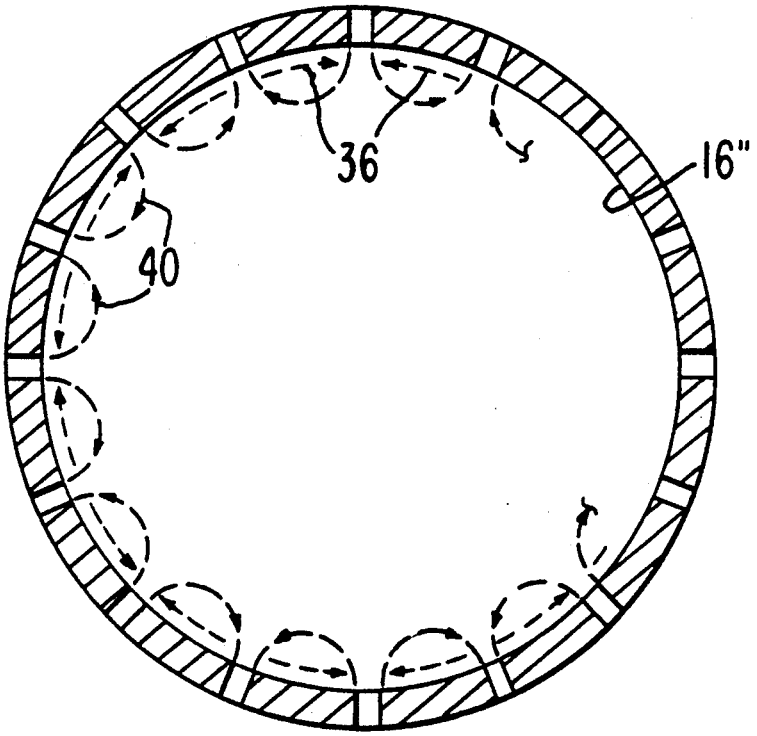
FIG. 3 is a plot of the transverse electric fields in the resonator of the gyrotron of FIG. 2.
Figure 4:
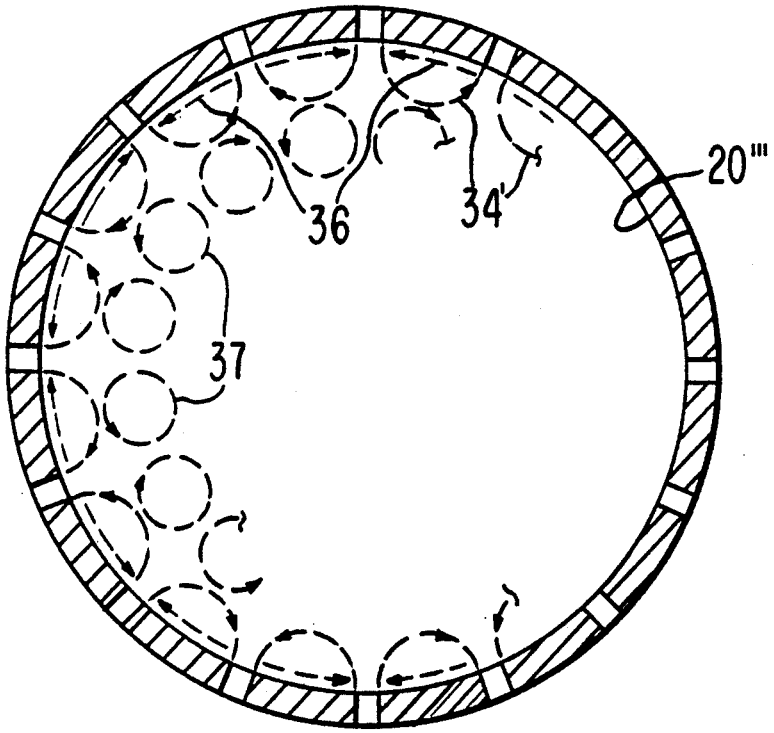
FIG. 4 is a plot of the transverse fields in the higher-order waveguide mode in the output waveguide.
Figure 5:
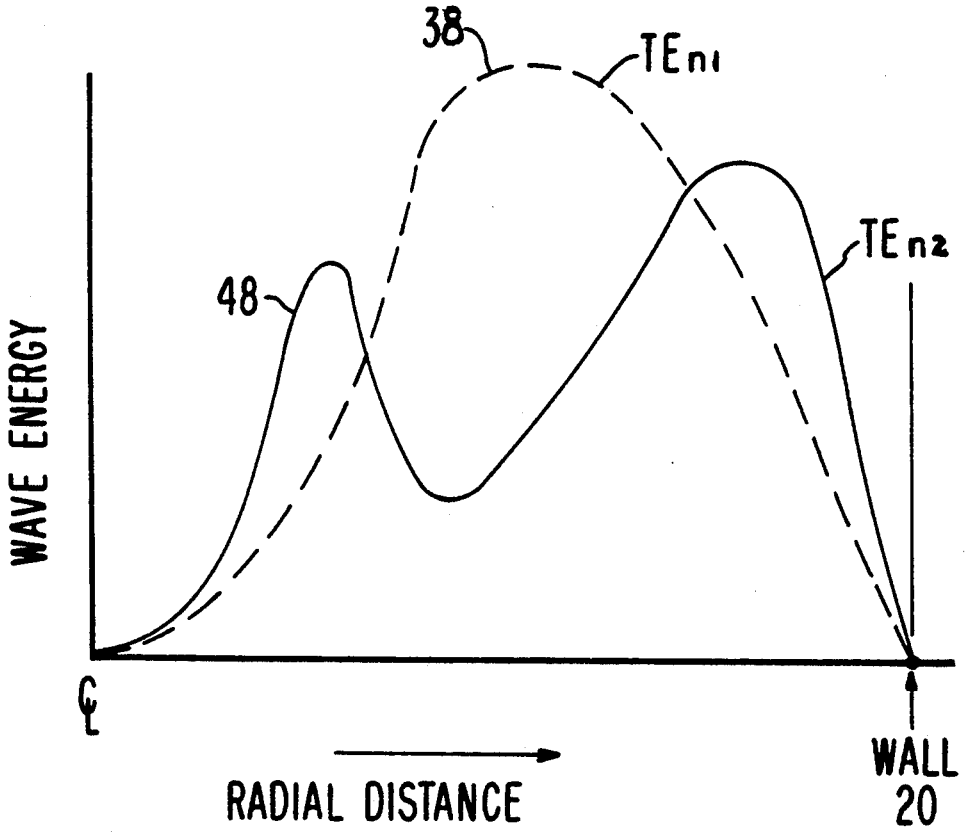
FIG. 5 is a plot of the radial variation of field strength of the two modes.

FIGS. 3, 4, and 5 show the patterns of transverse electric field for an embodiment of the invention using the $TE_{n1}$ or "whispering gallery" mode as the interaction mode, where n is a large integer.

FIG. 3 is a plot of transverse electric field lines 40 in the $TE_{8,1}$ mode in a cylindrical waveguide. The field is concentrated near the radius of the pipe, falling off rapidly to zero at the center. Arrows 36 indicate the currents on the hollow waveguide surface 16''. These currents at the ends of gap 24' generate waves scattered out through the gap.

FIG. 4 is a similar plot of the next higher mode having the same azimuthal mode number, the $TE_{8,2}$. Secondary loops of electric field 37 lie inside the primary loops 34', so that more wave energy flows nearer the center of the waveguide. This mode thus has, for the same total energy flow, lower fields and wall currents at the waveguide wall 20''' than the $TE_{8,1}$ mode of FIG. 3. It would traverse gap 24' with less radiation loss by diffraction into collector 25'. The mixed mode formed by combining the two will have even lower loss. These modes are, for clarity, of lower mode numbers than should be used in practice. Also, it is preferable to reduce mode competition to have mode number differing for 2 rather than 1, such as $TE_{nm}$ and $TE_{n,m+2}$. The double-subscript notation for circular waveguides as used herein is standard in the microwave field; specifically, the first subscript denotes the number of full cycles in the radial field pattern that is traversed when a radius sweeps 360°, and the second subscript denotes the number of half cycles of field variation along a radial component between the center and the walls.

FIG. 5 is a schematic graph of the radial variation 38 of field for a $TE_{n1}$ and 48, a $TE_{n2}$ mode. These are not necessarily optimum modes because of their proximity, but illustrated the principle. The $TE_{n1}$ has its energy 38 concentrated near the outside wall while the $TE_{n2}$ has more energy in field 48 closer to the center. When the two modes are mixed the distribution is more nearly uniform. For optimum performance the modes should have proper phase relationship at the gap. Since their phase velocities are slightly different, the phase at the gap can be fixed by selecting the proper length of waveguide 34 (FIG. 2) between mode converter 30 and gap 24'. This length may also be made adjustable.

The modes described above are simple ones of relatively low order to facilitate understanding. In practice much higher orders may be used to permit larger structures for handling more power. For example, the $TE_{15,m}$ has been used successfully. In this case the second higher order mode is preferably not the first adjacent $TE_{15,m+1}$ but the farther removed $TE_{15,m+2}$.

As an example of the effectiveness of the invention, theoretical calculations have predicted power loss of less than 3% for the dual mode composed of $TE_{15,2}$ plus $TE_{15,3}$. For the single-mode transmission of the prior art of FIG. 1 the predicted loss is over 10%.

Mode converter section 3 (FIG. 2) is most simply made by a periodic series of irregularities in the wall of cylindrical waveguide 20', such as ripples in diameter 32. The periodic length between ripples should be the beat wavelength between the two modes, that is the length over which the relative phases of the two modes shift by a full cycle, so that the cross-coupling is cumulative.

Many other embodiments of the invention will be obvious to those skilled in the art. For example, with gyrotrons operating the $TE_{on}$ modes with circular electric field, the converted $TE_{o,n+1}$ or $TE_{o,n+2}$ can be used to reduce diffraction loss at the gap. The invention is to be limited only by the following claims and their legal equivalents.

I claim:

1. In a gyrotron having an electron beam generator, an output waveguide, and a dielectric EM output window, a DC magnetic field generating means, an interaction circuit located between said electron beam generator and said output waveguide for receiving and transmitting an electron beam generated from said beam generator in a linear direction toward said output waveguide, said interaction circuit including a resonator capable of supporting and propagating an electromagnetic wave including energy associated therewith in a first transverse electric ($TE_{nm}$) mode having an azimuthal mode number n, said output waveguide coupled to said interaction circuit for propagating said electromagnetic wave in said first $TE_{nm}$ wave toward said EM window along a propagation path and for transmitting said electron beam away from said resonator toward a location away from said electron beam generator, said output waveguide having a gap therein, said gap being disposed between said resonator and said dielectric EM output window, said dielectric EM output window being mounted across an interior of said waveguide, THE IMPROVEMENT COMPRISING a portion of said output waveguide in the propagation path of said electromagnetic waves between said resonator and said gap being capable of also transmitting a second electromagnetic wave in a $TE_{nm}$ mode having a radial mode number m, different than the radial mode number of said first mode, and at least a part of said portion of said output waveguide in the propagation path of said electromagnetic wave between said resonator and the commencement of said gap being a mode converter for diverting part of the energy from said first mode into said second mode to reduce, in operation, leakage of wave energy from said output waveguide through said gap.

2. The gyrotron of claim 1 in which the azimuthal mode number n in the said first $TE_{nm}$ mode is a large number on the order of 15.

3. The gyrotron of claim 1 wherein all said modes are $TE_{on}$ modes.

4. The gyrotron of claim 1 wherein said output waveguide is circular in cross section and said mode converter is a periodic perturbation of an internal diameter of said output waveguide in said linear direction.

5. The gyrotron of claim 1 wherein said output waveguide includes a second portion, said second portion of said waveguide being on a side of said gap remote from said interaction circuit, said second portion of said waveguide includes a second mode converter for reconverting said second mode into said first mode.

6. The gyrotron of claim 5 wherein the said second portion of said waveguide has a first circular cross sectional region having a first diameter and a second circular cross sectional region having a second diameter, wherein the said first circular cross sectional region is adjacent said gap and said second circular cross sectional region is on the side of said second mode converter remote from said gap, and wherein said second diameter is smaller than said first diameter.

* * * * *